US010912970B1

(12) United States Patent
Hanhart et al.

(10) Patent No.: US 10,912,970 B1
(45) Date of Patent: Feb. 9, 2021

(54) GOLF CLUB HEAD HAVING ADJUSTABLE STRESS-REDUCING STRUCTURES

(71) Applicant: Callaway Golf Company, Carlsbad, CA (US)

(72) Inventors: Jeremy R. Hanhart, Oceanside, CA (US); Michael Hallack, Carlsbad, CA (US); Homer G. Aguinaldo, Chula Vista, CA (US); James A. Seluga, Carlsbad, CA (US); Christopher A.G. Nunez, Escondido, CA (US); Matthew Myers, Carlsbad, CA (US); Denver Holt, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/814,025

(22) Filed: Mar. 10, 2020

Related U.S. Application Data

(63) Continuation-in-part of application No. 16/363,899, filed on Mar. 25, 2019, now Pat. No. 10,589,154, (Continued)

(51) Int. Cl.
*A63B 53/04* (2015.01)
*A63B 53/06* (2015.01)
(Continued)

(52) U.S. Cl.
CPC ..... *A63B 53/06* (2013.01); *A63B 53/04* (2013.01); *A63B 53/047* (2013.01); *A63B 53/0466* (2013.01); *A63B 60/42* (2015.10); *A63B 53/045* (2020.08); *A63B 53/0408* (2020.08); *A63B 53/0433* (2020.08); *A63B 53/0437* (2020.08); *A63B 60/002* (2020.08); *A63B 2053/0491* (2013.01); *A63B 2209/02* (2013.01)

(58) Field of Classification Search
CPC ..... A63B 53/06; A63B 60/42; A63B 53/04; A63B 53/0466; A63B 53/047; A63B 53/045; A63B 53/0437; A63B 60/002; A63B 53/0433; A63B 53/0408; A63B 2053/0491; A63B 2209/02
See application file for complete search history.

(56) References Cited

U.S. PATENT DOCUMENTS 6,524,197 B2 * 2/2003 Boone ..... A63B 53/0466 473/324
7,914,393 B2 * 3/2011 Hirsch ..... A63B 60/54 473/332

(Continued)

*Primary Examiner* — William M Pierce
(74) *Attorney, Agent, or Firm* — Rebecca Hanovice; Michael Catania; Sonia Lari

(57) ABSTRACT

A golf club head comprising a body and a plurality of stiffening members, the tension or compression of which can be adjusted, is disclosed herein. The body comprises a face section, a sole section, and a crown section or a return section, and also defines a hollow interior. Each of the plurality of stiffening members is at least partially disposed within the hollow interior, and extends from the crown section or return section to the sole section to reduce stresses placed on the face during impact with a golf ball. The compression or tension of the stiffening members may be adjusted to affect the stresses experienced by the golf club head upon impact with a golf ball.

8 Claims, 12 Drawing Sheets

Related U.S. Application Data which is a continuation of application No. 15/392,818, filed on Dec. 28, 2016, now Pat. No. 10,238,933, which is a continuation-in-part of application No. 15/167,588, filed on May 27, 2016, now Pat. No. 9,889,349, which is a continuation-in-part of application No. 15/051,361, filed on Feb. 23, 2016, now Pat. No. 9,757,629, which is a continuation-in-part of application No. 14/997,199, filed on Jan. 15, 2016, now abandoned, which is a continuation-in-part of application No. 14/622,606, filed on Feb. 13, 2015, now Pat. No. 9,345,936, which is a continuation of application No. 13/906,572, filed on May 31, 2013, now Pat. No. 8,956,244, said application No. 14/997,199 is a continuation-in-part of application No. 14/788,326, filed on Jun. 30, 2015, now Pat. No. 9,597,558, and a continuation-in-part of application No. 14/794,578, filed on Jul. 8, 2015, now Pat. No. 9,814,947, which is a continuation-in-part of application No. 14/755,068, filed on Jun. 30, 2015, now Pat. No. 9,623,302, and a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 62/424,223, filed on Nov. 18, 2016, provisional application No. 61/665,203, filed on Jun. 27, 2012, provisional application No. 61/684,079, filed on Aug. 16, 2012.

(51) Int. Cl.
*A63B 60/42* (2015.01)
*A63B 60/00* (2015.01)

(56) References Cited

U.S. PATENT DOCUMENTS

| | | | | |
|---|---|---|---|---|
| 8,834,294 | B1 * | 9/2014 | Seluga | A63B 53/0466 473/338 |
| 8,956,244 | B1 * | 2/2015 | Westrum | A63B 53/06 473/338 |
| 9,067,110 | B1 * | 6/2015 | Seluga | A63B 60/02 |
| 9,180,349 | B1 * | 11/2015 | Seluga | A63B 53/047 |
| 9,216,332 | B1 * | 12/2015 | Ehlers | A63B 53/04 |
| 9,486,677 | B1 * | 11/2016 | Seluga | A63B 53/0466 |
| 9,597,558 | B1 * | 3/2017 | Seluga | A63B 60/00 |
| 9,597,561 | B1 * | 3/2017 | Seluga | A63B 53/06 |
| 9,687,702 | B1 * | 6/2017 | Seluga | A63B 53/0466 |
| 9,694,257 | B1 * | 7/2017 | Seluga | A63B 53/047 |
| 9,757,629 | B2 * | 9/2017 | Seluga | A63B 53/04 |
| 9,776,058 | B2 * | 10/2017 | Seluga | A63B 60/00 |
| 9,814,947 | B1 * | 11/2017 | Seluga | A63B 53/04 |
| 9,821,199 | B1 * | 11/2017 | Seluga | B22D 25/00 |
| 9,889,349 | B1 * | 2/2018 | Seluga | A63B 60/42 |
| 9,908,016 | B2 * | 3/2018 | Seluga | A63B 60/00 |
| 9,931,550 | B1 * | 4/2018 | Seluga | A63B 53/0466 |
| 10,065,085 | B2 * | 9/2018 | Seluga | A63B 60/52 |
| 10,238,933 | B1 * | 3/2019 | Seluga | A63B 53/06 |
| 10,406,408 | B1 * | 9/2019 | Seluga | A63B 60/00 |
| 10,532,258 | B2 * | 1/2020 | Seluga | A63B 53/042 |
| 10,589,154 | B2 * | 3/2020 | Seluga | A63B 60/00 |
| 2011/0224017 | A1 * | 9/2011 | Thomas | A63B 60/54 473/332 |
| 2013/0130829 | A1 * | 5/2013 | Bennett | A63B 53/06 473/337 |
| 2013/0130834 | A1 * | 5/2013 | Stites | A63B 60/00 473/346 |
| 2019/0201762 | A1 * | 7/2019 | Hebreo | A63B 60/42 |
| 2019/0217167 | A1 * | 7/2019 | Seluga | A63B 53/0466 |

* cited by examiner

GOLF CLUB HEAD HAVING ADJUSTABLE STRESS-REDUCING STRUCTURES

CROSS REFERENCES TO RELATED APPLICATIONS

The present application is a continuation-in-part of U.S. patent application Ser. No. 16/363,899, filed on Mar. 25, 2019, and issued on Mar. 17, 2020, as U.S. Pat. No. 10,589,154, which is a continuation of U.S. patent application Ser. No. 15/392,818, filed on Dec. 28, 2016, and issued on Mar. 26, 2019, as U.S. Pat. No. 10,238,933, which claims priority to U.S. Provisional Patent Application No. 62/424,223, filed on Nov. 18, 2016, and is a continuation-in-part of U.S. patent application Ser. No. 15/167,588, filed on May 27, 2016, which is a continuation-in-part of U.S. patent application Ser. No. 15/051,361, filed on Feb. 23, 2016, which is a continuation-in-part of U.S. patent application Ser. No. 14/997,199, filed on Jan. 15, 2016, which is a continuation-in-part of U.S. patent application Ser. No. 14/788,326, filed on Jun. 30, 2015, and is also a continuation-in-part of U.S. patent application Ser. No. 14/794,578, filed on Jul. 8, 2015, which is a continuation-in-part of U.S. patent application Ser. No. 14/755,068, filed on Jun. 30, 2015, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application Nos. 61/665,203, filed on Jun. 27, 2012, and 61/684,079, filed on Aug. 16, 2012, the disclosure of each of which is hereby incorporated by reference in its entirety herein. U.S. patent application Ser. No. 15/167,588 also is a continuation-in-part of U.S. patent application Ser. No. 14/713,090, filed on May 15, 2015, and issued on May 31, 2016, as U.S. Pat. No. 9,352,199, which is a continuation of U.S. patent application Ser. No. 14/159,262, filed on Jan. 20, 2014, and issued on Jun. 30, 2015, as U.S. Pat. No. 9,067,110, the disclosure of each of which is hereby incorporated by reference in its entirety herein. U.S. patent application Ser. No. 14/997,199 also is a continuation-in-part of U.S. patent application Ser. No. 14/622,606, filed on Feb. 13, 2015, and issued on May 24, 2016, as U.S. Pat. No. 9,345,936, which is a continuation of U.S. patent application Ser. No. 13/906,572, filed on May 31, 2013, and issued on Feb. 17, 2015, as U.S. Pat. No. 8,956,244, the disclosure of each of which is incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with stress-reducing stiffening members disposed proximate a striking face, the compression and tension of which can be adjusted.

Description of the Related Art

The prior art discloses various golf club heads having interior structures. For example, Kosmatka, U.S. Pat. No. 6,299,547 for a Golf Club Head with an Internal Striking Plate Brace, discloses a golf club head with a brace to limit the deflection of the striking plate. Yabu, U.S. Pat. No. 6,852,038 for a Golf Club Head and Method of Making the Same, discloses a golf club head with a sound bar. Galloway, U.S. Pat. No. 7,118,493 for a Multiple Material Golf Club Head discloses a golf club head with a composite aft body having an interior sound component extending upward from a sole section of a metal face component. Seluga et al., U.S. Pat. No. 8,834,294 for a Golf Club Head with Center of Gravity Adjustability discloses a golf club head with a tube having a mass for adjusting the CG of a golf club head. Dawson et al., U.S. Pat. No. 8,900,070 for a Weighted Golf Club Head discloses a golf club head with an interior weight lip extending from the sole towards the face. However, the prior art fails to disclose an interior structure that increases ball speed and reduces stress in the face at impact, with a minimal increase in mass to the golf club head, and that can be adjusted to preload the golf club head.

BRIEF SUMMARY OF THE INVENTION

The golf club head comprises a plurality of interior structures located proximate a rear surface of a striking face to reduce the stress in the face during impact with a golf ball. The structures preferably are fixed at one end to the golf club body and can be compressed or placed into tension via a structure located at the other end by a golfer or manufacturer to preload the body, and thereby adjust the stresses experienced by certain portions of the golf club head.

One aspect of the present invention is a golf club head comprising a body comprising a striking face section having a face interior surface, an upper perimeter and a lower perimeter, a crown return extending rearward from the upper perimeter of the striking face section, a sole section extending rearward from the lower perimeter of the striking face section, a hollow interior, and a support structure extending into the hollow interior from the sole section, a first rod comprising a first upper end, a first midpoint, a first lower end, and a first plate affixed to the first lower end, and a first shim comprising a first body and a first flange, wherein the support structure comprises a first pocket with a first floor and a first through-hole extending through the first floor in communication with the hollow interior, wherein the first upper end of the first rod is permanently affixed to the crown return section, wherein the first midpoint of the first rod is suspended within the hollow interior, wherein the first lower end of the first rod extends through the first through-hole so that the first plate is disposed outside of the hollow interior and is received within the first pocket, wherein the first shim is disposed within the first pocket so that the first flange extends between the first plate and the first floor, wherein each of the first rod and the support structure is located entirely within one inch of the interior surface of the striking face section, and wherein no portion of the first rod and support structure makes contact with the striking face section.

In some embodiments, the first flange may move the first plate away from the sole section and increase tension of the first rod. In other embodiments, the first body of the first shim may be sized to fit within and fill the first pocket. In still other embodiments, the golf club head may further comprise a second rod having a second upper end, a second midpoint, a second lower end, and a second plate, the support structure may comprise a second pocket with a second floor and a second through-hole extending through the second floor and in communication with the hollow interior, the second upper end of the second rod may be permanently affixed to the crown return section, the second midpoint of the second rod may be suspended within the hollow interior, and the second lower end of the second rod may extend through the second through-hole so that the second plate is disposed outside of the hollow interior and is received within the second pocket. In further embodiments, each of the first rod and the second rod may have a variable diameter, and the support structure may comprise a divider wall that separates the first pocket from the second pocket. In another embodiment, the golf club head may comprise a cover piece, which may be affixed to the body to cover the first pocket of the support structure. In a further embodiment, the body may be composed of a first material having a first density, the cover piece may be composed of a second material having a second density, and the second density may be less than the first density.

Another aspect of the present invention is a golf club head comprising a body comprising a striking face section having a face interior surface, an upper perimeter and a lower perimeter, a crown return section extending rearward from the upper perimeter of the striking face section, a sole section extending rearward from the lower perimeter of the striking face section, a hollow interior, and a first port extending into the hollow interior from the sole section, a first rod comprising a first upper end, a first midpoint, a first lower end, and a first threaded counter-bore extending into the first lower end, and a first tuning screw comprising a first head and a first threaded extension portion, wherein the first port comprises a first boss and a first ledge, wherein the first upper end of the first rod is permanently affixed to the crown return section, wherein the first midpoint of the first rod is suspended within the hollow interior, wherein the first lower end of the first rod extends into the first boss of the first port so that the first counter-bore is aligned with the first port, wherein the first threaded extension portion of the first tuning screw extends into the first port and engages with threads of the first threaded counter-bore, wherein each of the first rod and the first port is located entirely within one inch of the interior surface of the striking face section, and wherein no portion of the first rod and first port makes contact with the striking face section.

In some embodiments, tightening the first tuning screw within the first port may cause the first threaded extension portion to move further inside the first threaded counter-bore and the first head to abut the first ledge of the first port, and increases tension in the first rod. In other embodiments, the first rod may have a variable diameter. In still other embodiments, the golf club head may further comprise a second rod comprising a second upper end, a second midpoint, a second lower end, and a second threaded counter-bore extending into the second lower end, a second tuning screw comprising a second head and a second threaded extension portion, the sole section may comprise a second port comprising a second boss and a second ledge, the second upper end of the second rod may be permanently affixed to the crown return section, the second midpoint of the second rod may be suspended within the hollow interior, the second lower end of the second rod may extend into the second boss of the second port so that the second counter-bore is aligned with the second port, and the second threaded extension portion of the second tuning screw may extend into the second port and engage with the threads of the second threaded counter-bore. In a further embodiment, tightening the second tuning screw within the second port may cause the second threaded extension portion to move further inside the second threaded counter-bore and the second head to abut the second ledge of the second port, and increase tension in the second rod.

Yet another aspect of the present invention is a golf club head comprising a body comprising a striking face section having a face interior surface, an upper perimeter and a lower perimeter, a crown return section extending rearward from the upper perimeter of the striking face section, a sole section extending rearward from the lower perimeter of the striking face section, a hollow interior, and a first port extending into the hollow interior from the sole section, a first rod comprising a first upper end, a first midpoint, and a first threaded lower end, and a first tuning screw comprising a first head, a first extension portion, and a first threaded counter-bore extending into the first extension portion and sized to receive the first threaded lower end of the first rod, wherein the first port comprises a first boss and a first ledge, wherein the first upper end of the first rod is affixed to the crown return section, wherein the first midpoint of the first rod is suspended within the hollow interior, wherein the first threaded lower end of the first rod extends into the first boss of the first port, wherein the first extension portion of the first tuning screw extends into the first port so that the first threaded counter-bore engages the first threaded lower end of the first rod, wherein each of the first rod and the first port is located entirely within one inch of the interior surface of the striking face section, and wherein no portion of the first rod and first port makes contact with the striking face section. In some embodiments, tightening the first tuning screw within the first port may cause the first threaded lower end to move further inside the first threaded counter-bore and the first head to abut the first ledge of the first port, and increase tension in the first rod. In any embodiments, the first rod may have a variable diameter.

Another aspect of the present invention is a golf club head comprising a body comprising a striking face section having a face interior surface, an upper perimeter and a lower perimeter, a crown return section extending rearward from the upper perimeter of the striking face section, a sole section extending rearward from the lower perimeter of the striking face section, a hollow interior, and a first threaded port extending into the hollow interior from the sole section, a first rod comprising a first upper end, a first midpoint, a first lower end, and a first plate affixed to the first lower end, and a first collar comprising a first through-opening, a first ledge, and a first threaded exterior surface encircling a first collar space, wherein the first upper end of the first rod is affixed to the crown return section, wherein the first midpoint of the first rod is suspended within the hollow interior, wherein the first lower end extends through the first through-opening of the first collar so that the first plate is disposed within the first collar space, wherein threads of the first threaded exterior surface engage with threads of the first threaded port to reversibly affix the first collar to the body, wherein each of the first rod and the first port is located entirely within one inch of the interior surface of the striking face section, and wherein no portion of the first rod and the first port makes contact with the striking face section. In some embodiments, moving the first collar within the first port may change the tension in the first rod. In other embodiments, the first rod may have a variable diameter. In any of the embodiments, each of the body and the first rod may be composed of a titanium alloy.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
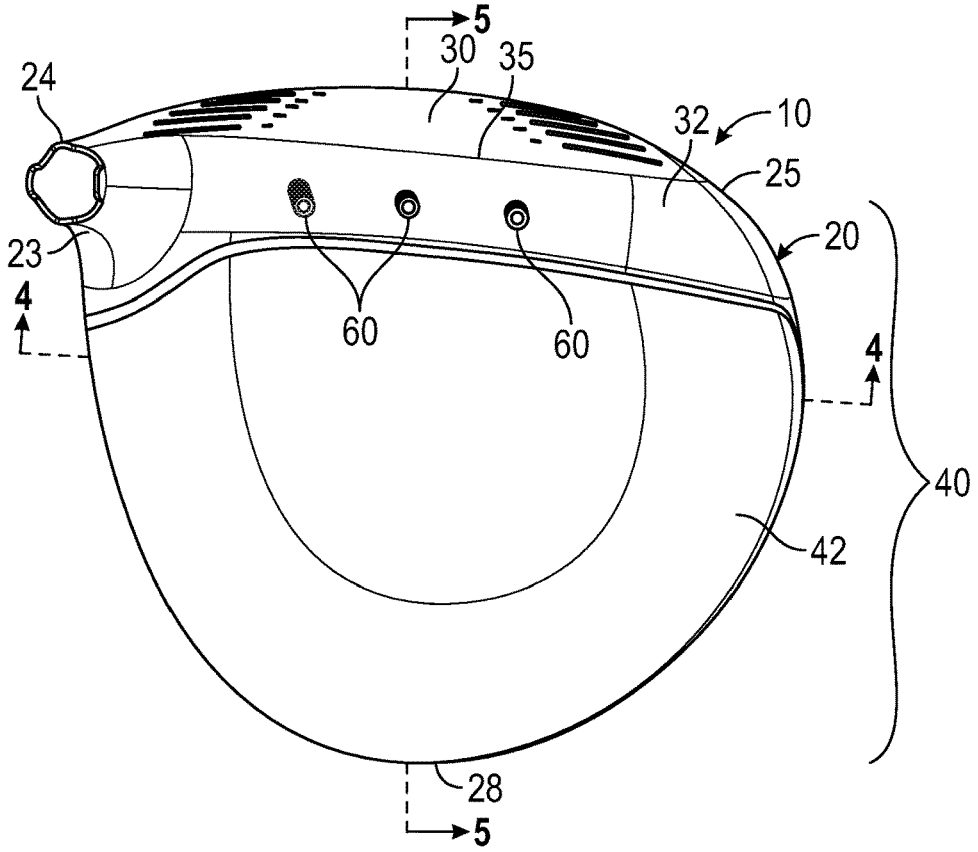
FIG. 1 is a top elevational view of an embodiment of the golf club head of the present invention.
Figure 2:
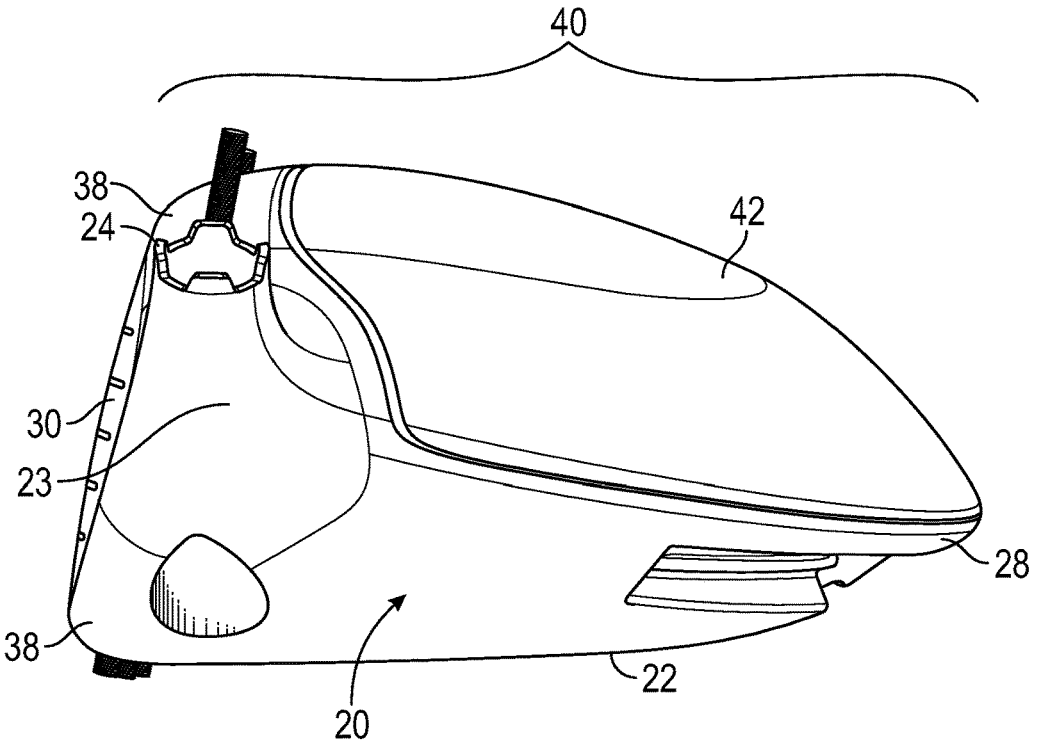
FIG. 2 is a side elevational view of the golf club head shown in FIG. 1.
Figure 3:
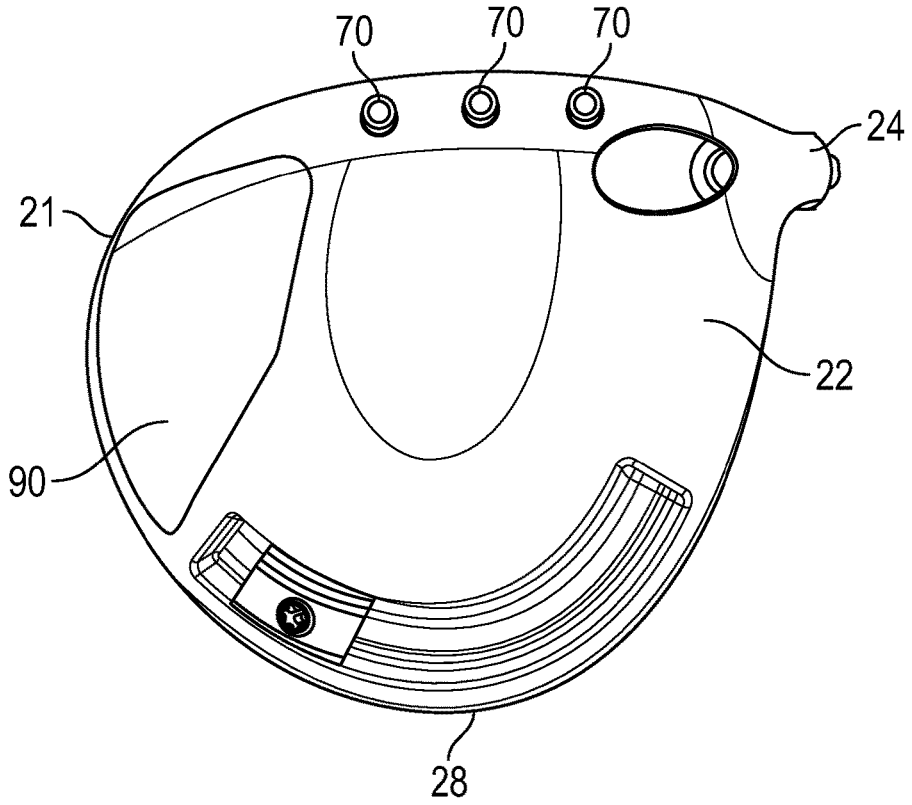
FIG. 3 is a sole elevational view of the golf club head shown in FIG. 1.
Figure 4:
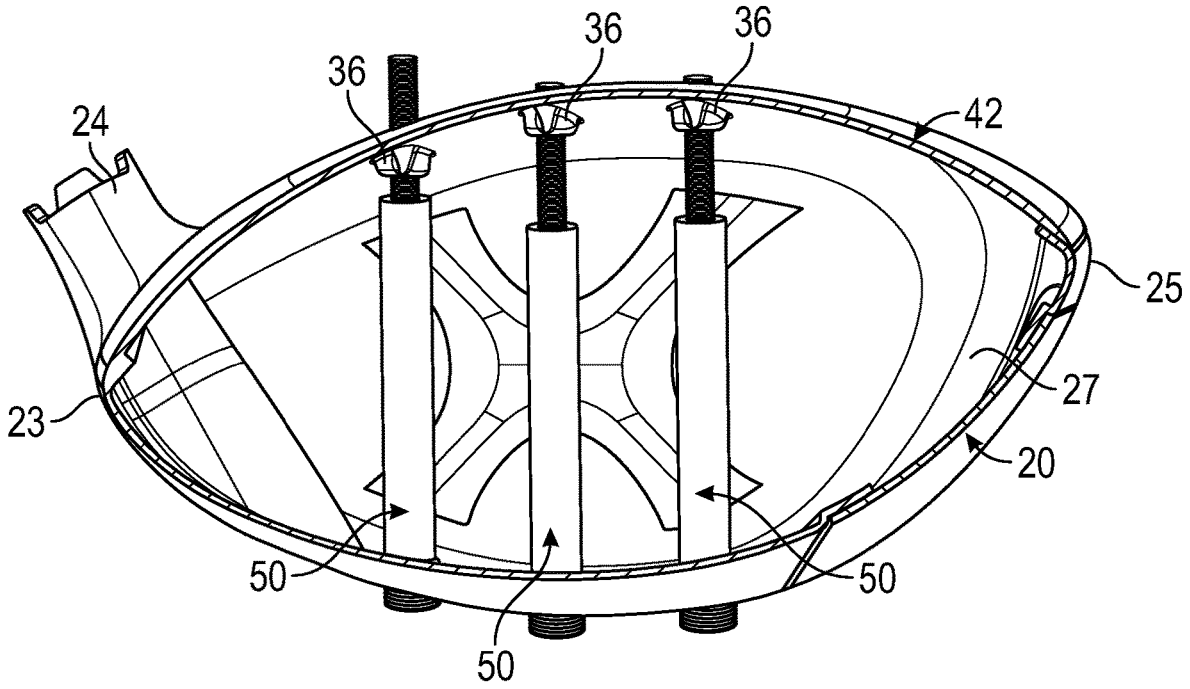
FIG. 4 is a cross-sectional view of the golf club head shown in FIG. 1 along lines 4-4.
Figure 5:
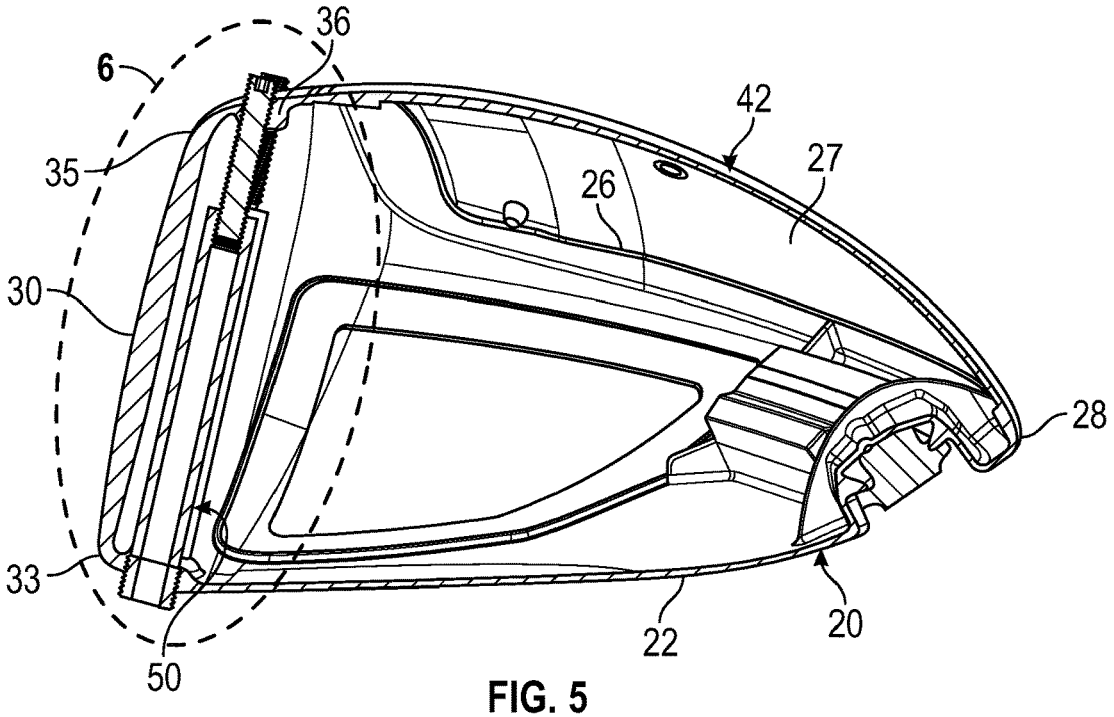
FIG. 5 is a cross-sectional view of the golf club head shown in FIG. 1 along lines 5-5.
Figure 6:
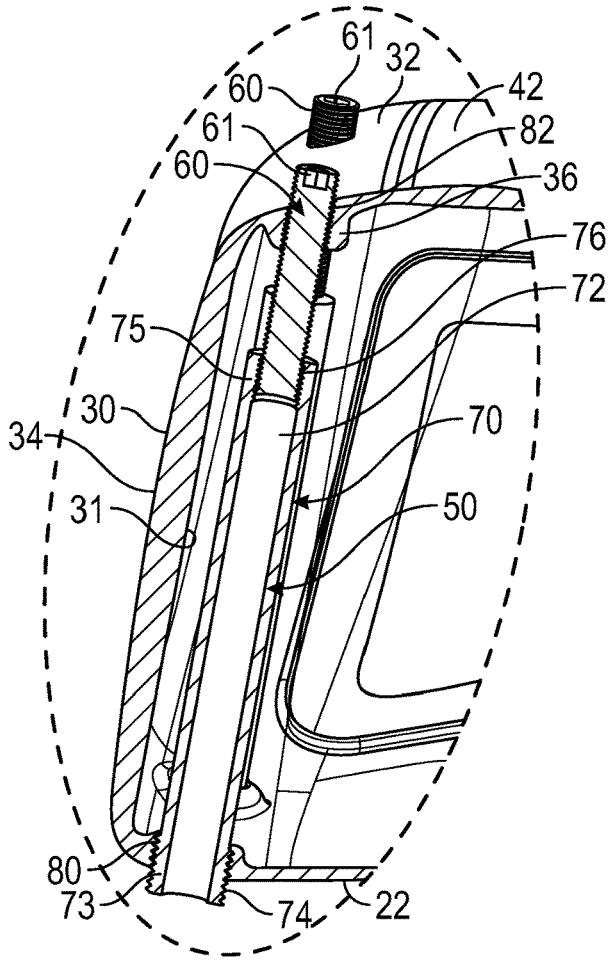
FIG. 6 is an enlarged view of the circled portion of the embodiment shown in FIG. 5.
Figure 7:
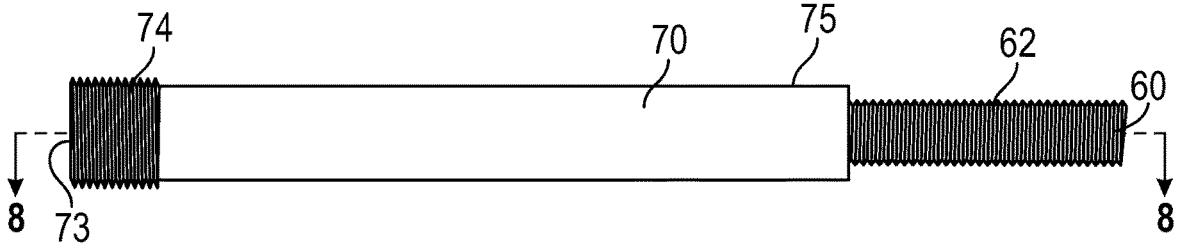
FIG. 7 is a side elevational view of one of the stiffening members shown in FIG. 1.
Figure 8:
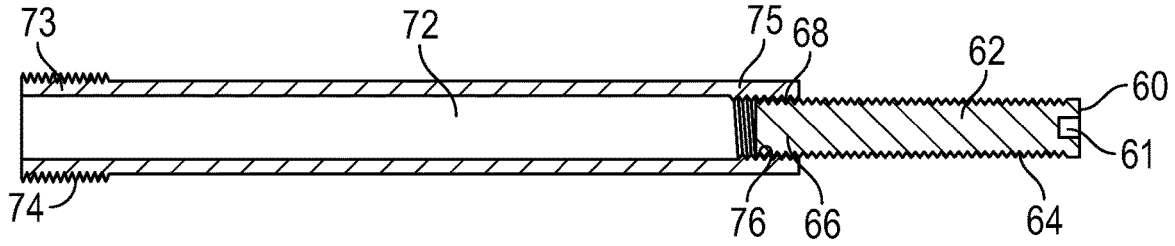
FIG. 8 is a cross-sectional view of the stiffening member shown in FIG. 7 along lines 8-8.
Figure 9:
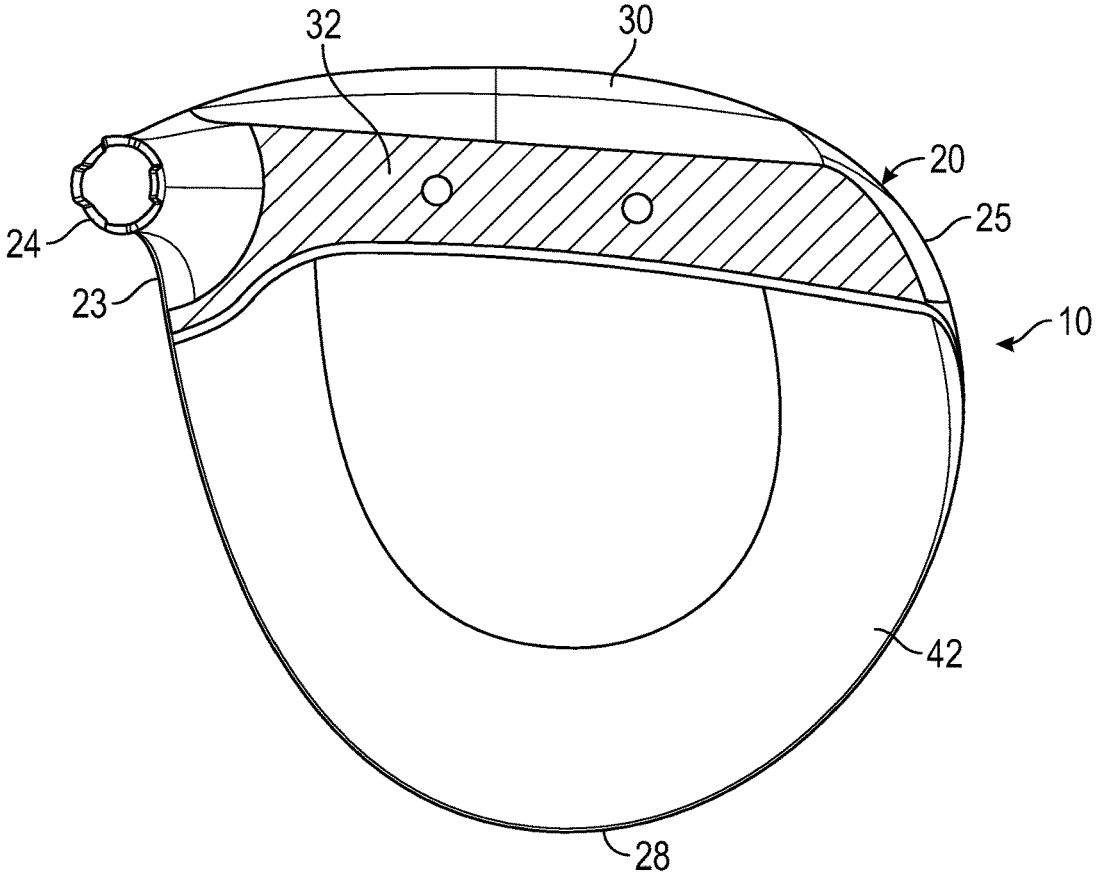
FIG. 9 is a top plan view of a second embodiment of the golf club head of the present invention.
Figure 10:
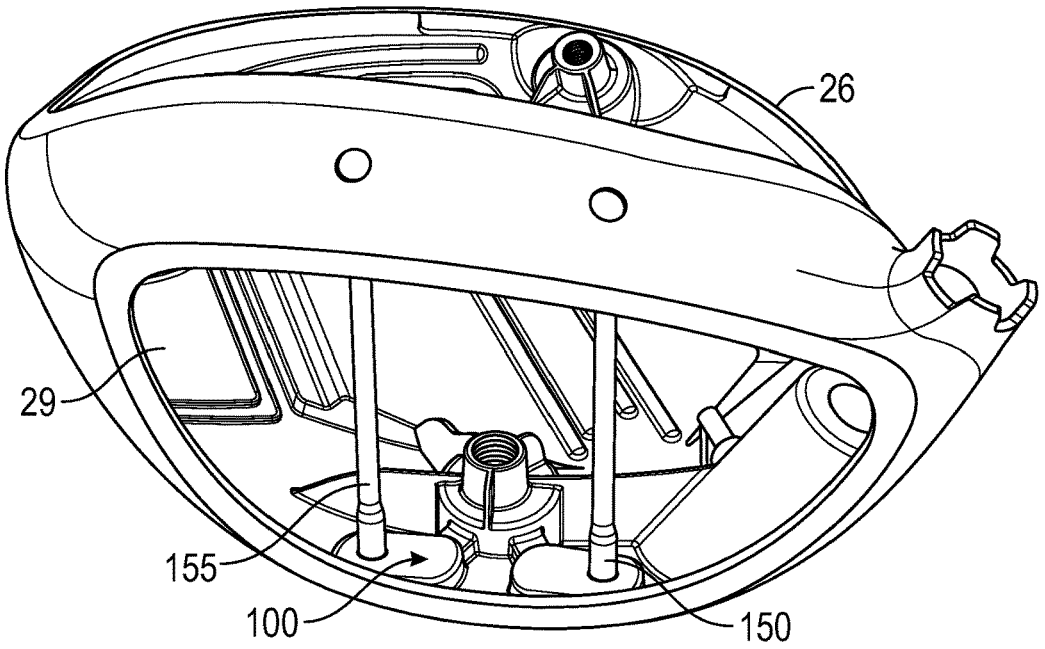
FIG. 10 is a front perspective view of the embodiment shown in FIG. 9 with the crown and face insert removed.
Figure 11:
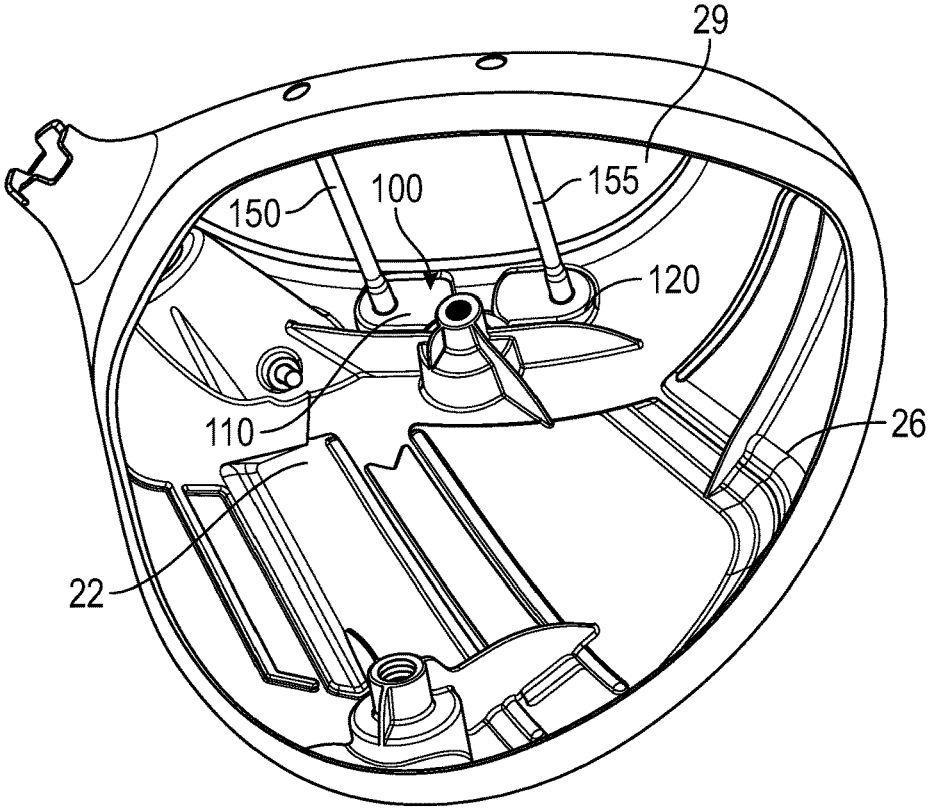
FIG. 11 is a rear perspective view of the embodiment shown in FIG. 10.
Figure 12:
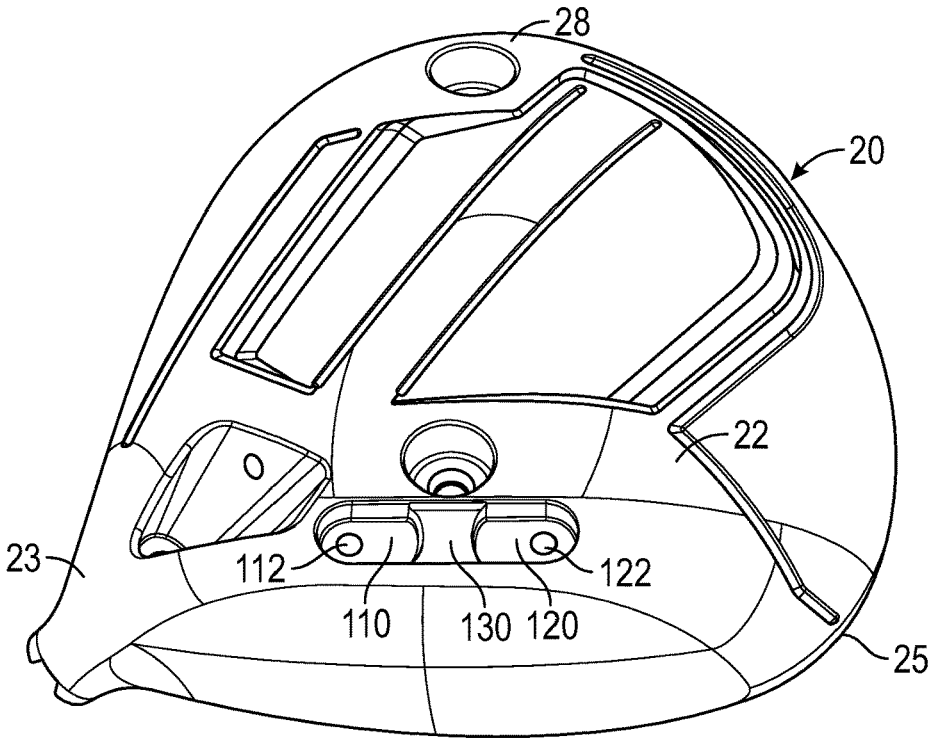
FIG. 12 is a bottom elevational view of the embodiment shown in FIG. 10.
Figure 13:
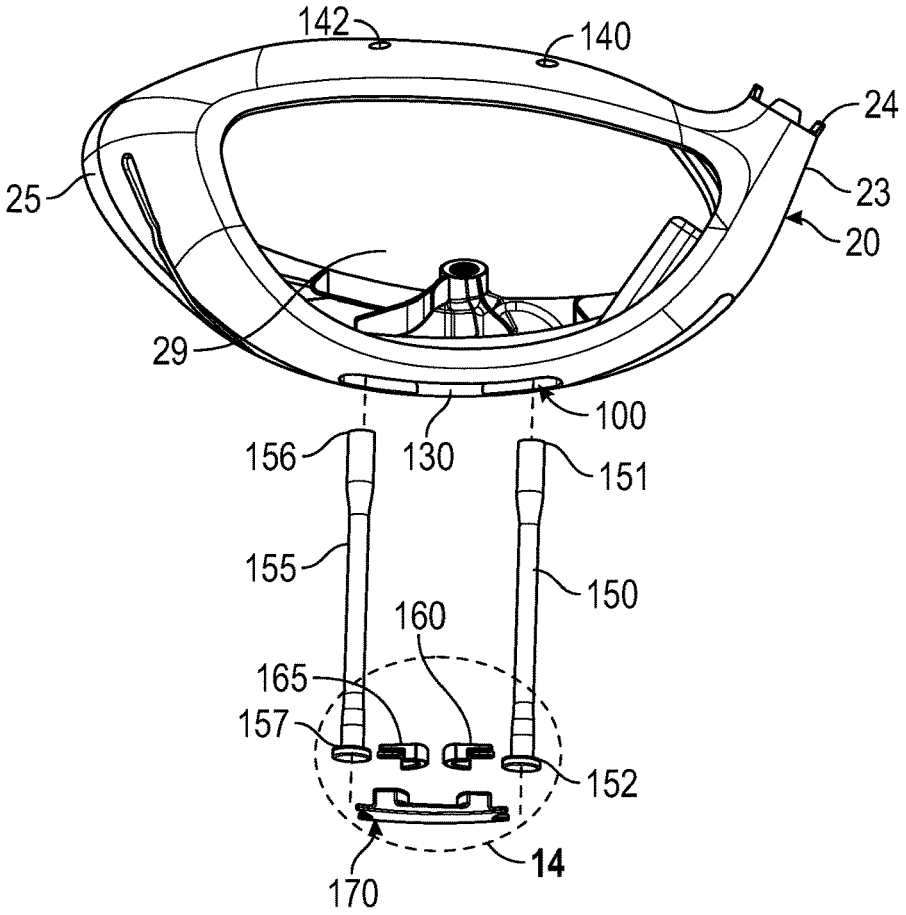
FIG. 13 is an exploded view of the embodiment shown in FIG. 10.
Figure 14:
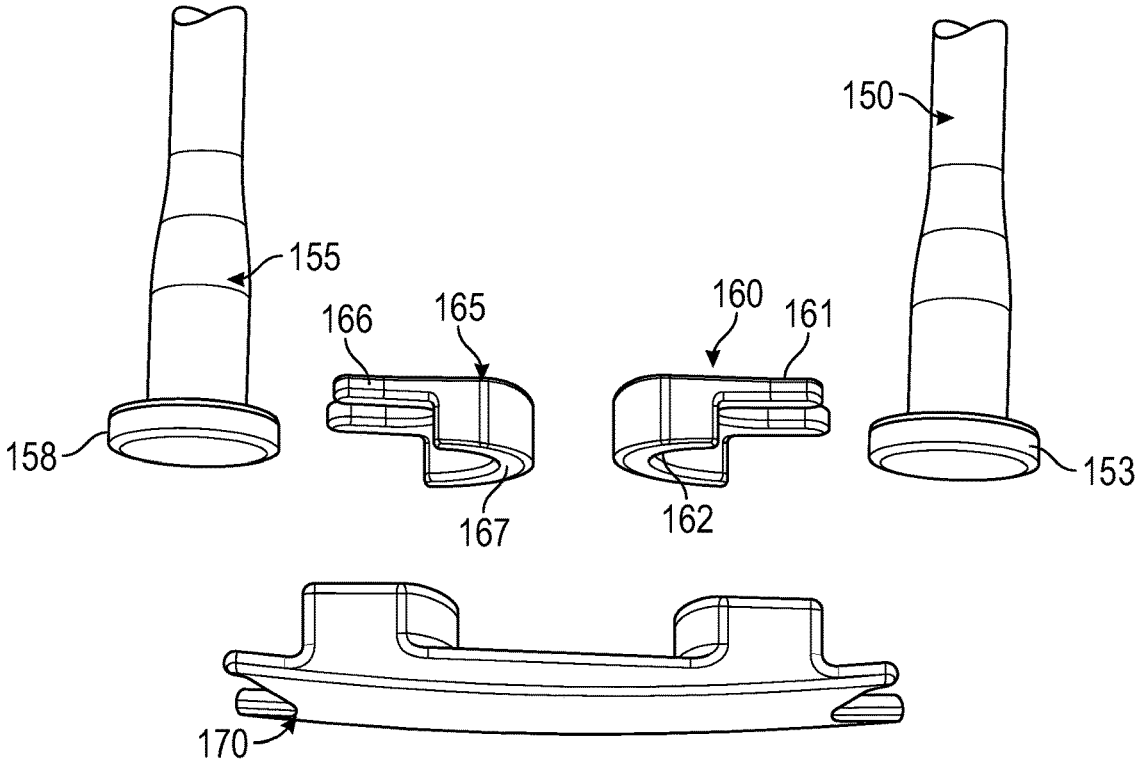
FIG. 14 is an enlarged view of the circled portion of the embodiment shown in FIG. 13.
Figure 15:
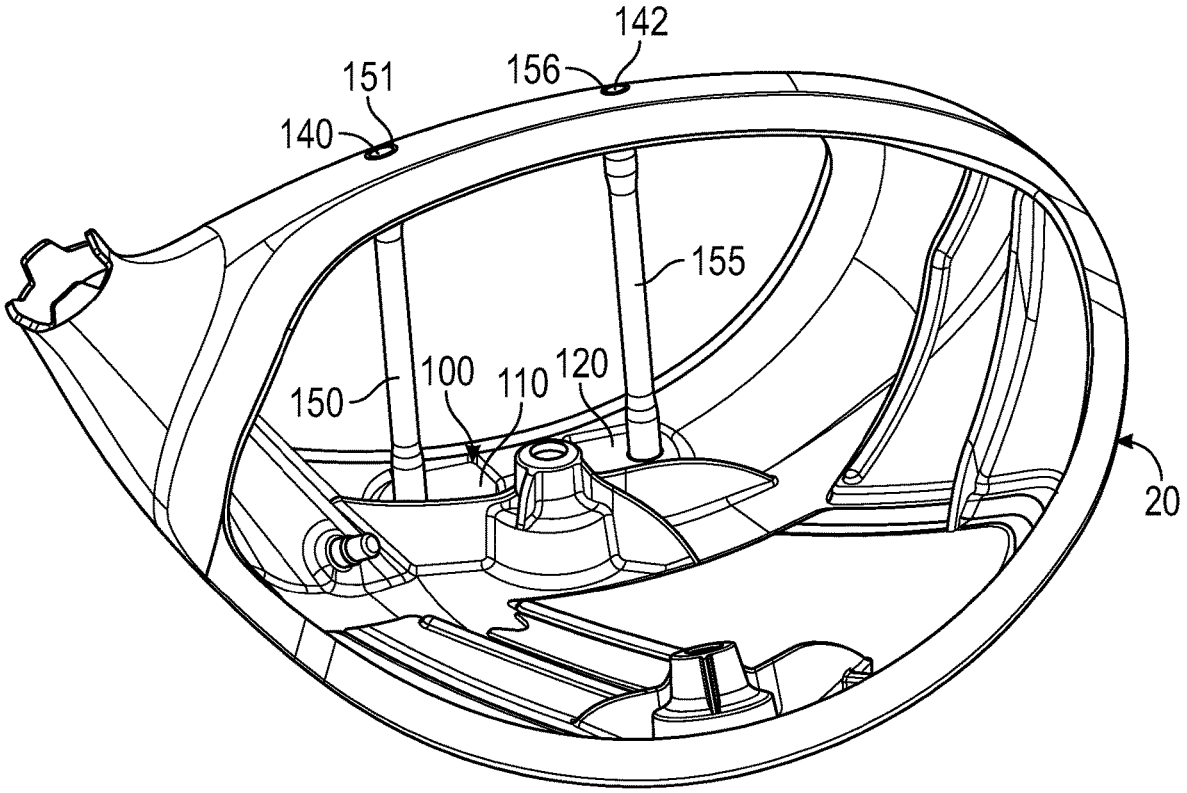
FIG. 15 is a rear perspective view of the embodiment shown in FIG. 10
Figure 16:
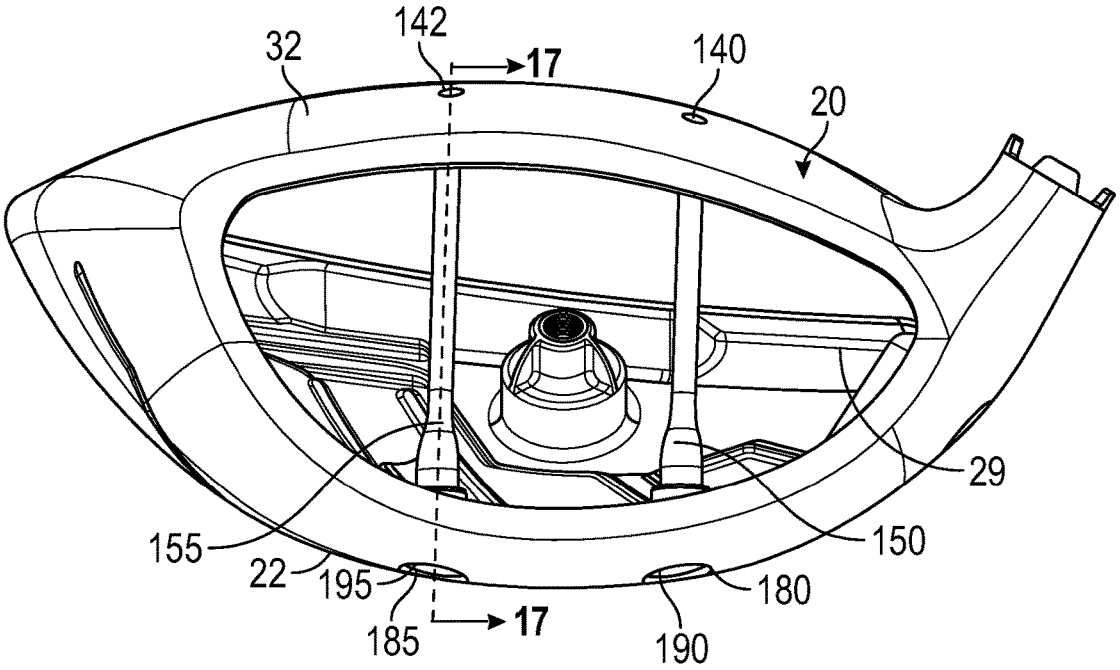
FIG. 16 is a front elevational view of a third embodiment of the golf club head of the present invention with its crown and face insert removed.
Figure 17:
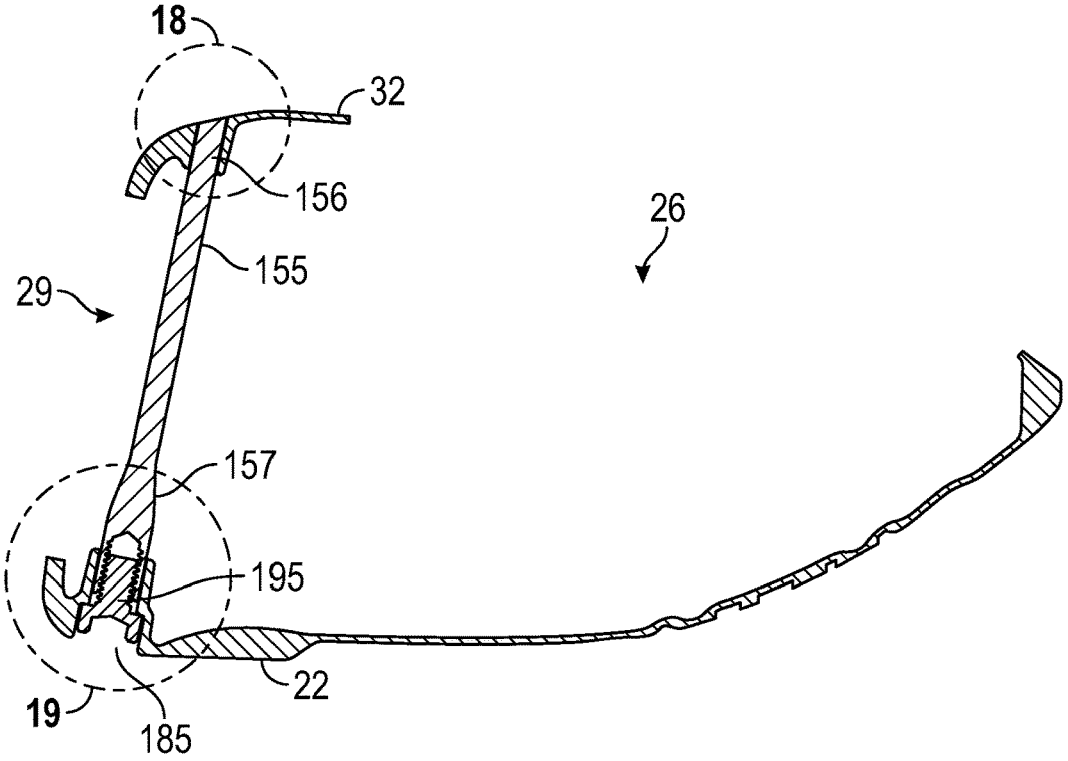
FIG. 17 is a cross-sectional view of the embodiment shown in FIG. 16 along lines 17-17.
Figure 18:
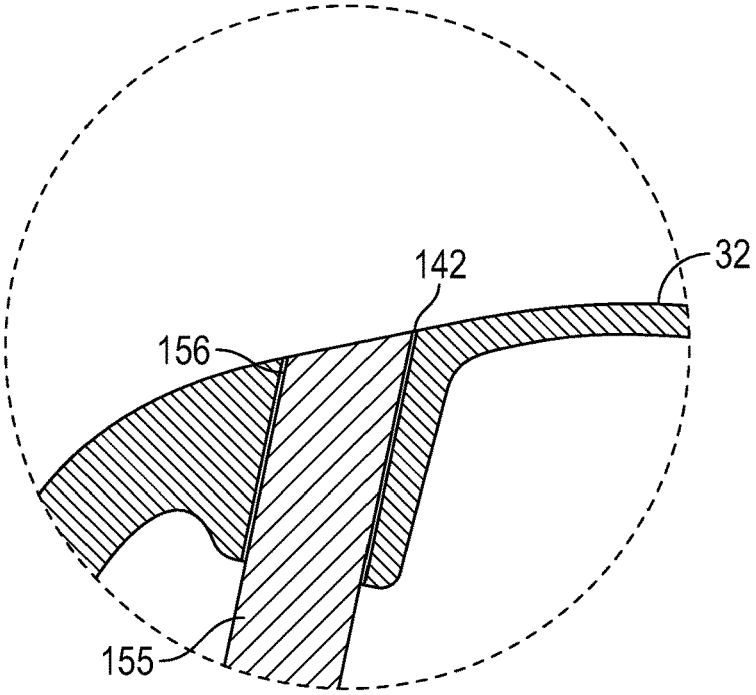
FIG. 18 is an enlarged view of the circled portion of the embodiments shown in FIGS. 17, 20, and 22.
Figure 19:
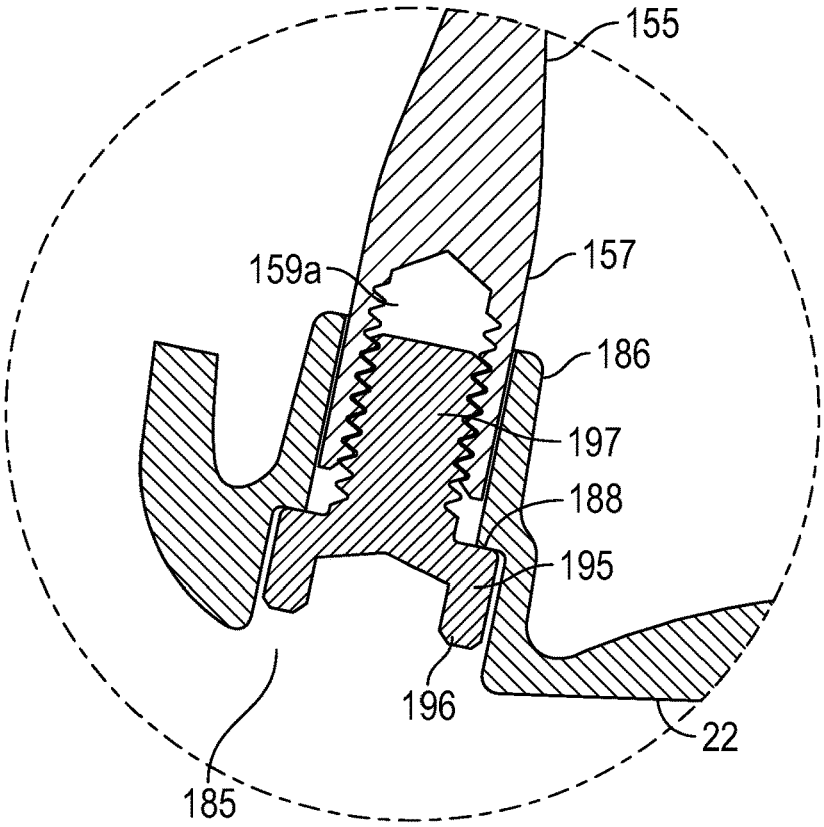
FIG. 19 is an enlarged view of the circled portion of the embodiment shown in FIG. 17.

A first embodiment of the golf club head 10 of the present invention is shown in FIGS. 1-8. The golf club head 10 includes a body 20 having a sole section 22 that extends away from a lower edge 33 of a striking face section 30, a return section 32 extending away from an upper edge 35 of the striking face section 30, a hosel 24 for engaging a shaft, a heel end 23, a toe end 25, an upper opening 26, a hollow interior 27, and an aft end 28. The area where the return section 32 and sole section 22 connect with the striking face section 30 is known as the hinge region 38. A crown section 40 is comprised of the return section 32 and a crown insert 42 that is placed over the upper opening 26 to enclose the hollow interior 27. Within the hollow interior 27, three stiffening members 50 extend from the sole section 22 upward to the return section 32. In an alternative embodiment, the stiffening members 50 may extend to the crown insert 42 instead; what is important is that the stiffening members 50 connect the crown section 40 to the sole section 22, and that no part of the stiffening members 50 touches the striking face section 30 or is located more than 1 inch away from an interior surface 31 of the striking face section 30 in a front-to-back direction. In yet another alternative embodiment, only one or two stiffening members 50 may be engaged with the golf club head 10.

As shown in FIGS. 4-8, each of the stiffening members 50 in the first embodiment comprises an externally threaded rod 60 and a tube 70 with a through-bore 72 sized to receive the rod 60. The rod 60 has a first portion 62 with a first set of external threads 64 and a second portion 66 with a second set of external threads 68 oriented in a different direction than the first set of external threads 64; one set is right-handed, the other left-handed. A first end 73 of the tube 70 comprises external threads 74 and the second end 75 of the tube 70 comprises internal threads 76 sized to mate with one of the first and second sets of external threads 64, 68. Each of the return section 32 (or the crown section 40) and sole section 22 comprises threaded openings 80, 82, one of which is sized to mate with the external threads 74 of the tube 70 and the other one of which is sized to mate with one set of external threads 64, 68 of the rod 60. The openings 82 in the return section 32 preferably are supported by a plurality of bosses 36 extending into the hollow interior 27 of the body 20. During manufacturing, a tap can be used to independently thread the openings 80, 82 in the return section 32 and sole section 22, and the distance between each threaded end of each stiffening member 50 can be adjusted to allow alignment of the pitch of the rods 60 and tubes 70 with the pitch of the tapped return section 32 and sole section 22.

This construction allows each stiffening member 50 to be adjusted by a manufacturer or user so that the stiffening member 50 can be put in either compression or tension, placing different preloads on the spanned golf club head 10 and thus affecting the maximum stress experienced by certain portions of the structure, and particularly the striking face section 30, upon impact with a golf ball. Preloading is accomplished using a tool, such as a torque wrench or a screwdriver, which engages a tool opening 61 in the rod 60 to torque and push or pull the rod 60 further into or out of the sole section 22 or crown section 40. Preloading each stiffening member 50 as described, and particularly placing the stiffening members 50 in compression, reduces the peak stress placed on the striking face section 30 when the golf club head 10 impacts a golf ball, thereby reducing the risk that the striking face section 30, and particularly the hinge region 38, will crack under impact load. When all of the stiffening members 50 are preloaded to be in compression, the peak stress placed on the region of the body 20 located between the stiffening members 50 and the striking face section during impact with a golf ball is also lowered, as illustrated in Table I. In effect, preloading improves the resilience of the golf club head 10 during impact with a golf ball by distributing the stresses more evenly.

Table I shows peak stresses, in ksi, of the striking face section 30, inner mold line (IML) of the hinge region 38, and outer mold line (OML) of the hinge region 38 of the golf club head 10 of the present invention under the following conditions: (1) 20 lb node forces applied around the perimeter of each boss 36 parallel with the vector of each individual stiffening member 50, and in a way such that the net resultant force on the body 20=zero, while the total nodal forces=480 lb per stiffening member 50; (2) application of two sets of forces, one to shrink or compress the stiffening members 50, and one to extend or tension the stiffening members 50; (3) forces applied during the initial dynamic relaxation phase to simulate preload, such that the body 20 had reached equilibrium before transient impact portion of the analysis was conducted.

TABLE I

| Stiffening Member Configuration | Face Stress | IML Hinge Stress | OML Hinge Stress |
|---|---|---|---|
| Standard (control) | 168 | 162 | 222 |
| Compression | 168 | 132 | 189 |
| Tension | 176 | 198 | 258 |

Once the stiffening members 50 are placed in tension or compression so that the golf club head 10 is preloaded to a desired load value, any excess length of the stiffening members 50 extending through the openings 80, 82 is removed by any means known to a person of ordinary skill in the art, including but not limited to machining or cutting. The stiffening members 50 can then be permanently affixed to the golf club head via welding, brazing, or soldering, or with an adhesive such as Loctite®, though this step is not required and can be bypassed if a golfer wants to retain the ability to adjust the load placed on the stiffening members 50.

In a second, preferred embodiment, shown in FIGS. 9-15, the golf club head 10 has many of the same features as the first embodiment. Some key differences include: the body 20 includes a front opening 29 sized to receive a face insert 30; the stiffening members are two unthreaded rods 150, 155 with first and second ends 151, 152, 156, 157, respectively; and the sole section 22 includes a stiffening member support structure 100 disposed proximate the front opening 29. Each of the rods 150, 155 preferably has a variable diameter, as shown in U.S. Pat. No. 10,532,258, the disclosure of which is hereby incorporated by reference in its entirety herein. Each rod 150, 155 has a plate 153, 158 affixed to its second end 152, 157, which is "floating" with respect to the rest of the body 20. The support structure 100 includes a heel side pocket 110 and a toe side pocket 120, neither of which comprises threading, and which are separated from one another by a divider wall 130. Each of the heel side pocket 110 and the toe side pocket 120 comprises a through-hole 112, 122 sized to receive one of the unthreaded rods 150, 155. Similarly, the return section 32 comprises two unthreaded through-openings 140, 142 sized to receive the first ends 151, 156 of the rods 150, 155.

The rods 150, 155 are attached to the body by threading the first ends 151, 156 through the through-holes 112, 122 of the support structure 100 and through the hollow interior 27 of the body 20 until the first end 151 of the first rod 150 is received within the first through-opening 140 of the return section 32 and the first end 156 of the second rod 155 is received within the second through-opening 142 of the return section 32. The first end 151 of the first rod 150 is welded or otherwise permanently affixed to the body 20 within the through-opening 140, and the first end 156 of the second rod 155 is welded or otherwise permanently affixed to the body 20 within the other through-opening 142.

When the rods are engaged with the return section 32 as described above, the plates 153, 158 abut the support structure, the first plate 153 received within the heel side pocket 110 and the second plate 158 received within the toe side pocket 120. This construction prevents the second ends 152, 157 of the rods 150, 155 from entering the hollow interior 27, and places the rods 150, 155 in tension between the return section 32 and the sole section 22. The tension of the first rod 150 can be increased by inserting a flange 161 of a first shim 160 between the first plate 153 and the floor 111 of the heel side pocket 110, which pulls the first rod 150 away from the sole section 22. The body 162 of the first shim 160 is sized to fit within, and preferably fill, a portion of the heel side pocket 110. Similarly, the tension of the second rod 155 can be increased by inserting a flange 166 of a second shim 165 between the second plate 158 and the floor 121 of the toe side pocket 120, which pulls the second rod 155 away from the sole section 22. The body 167 of the second shim 165 is sized to fit within, and preferably fill, a portion of the toe side pocket 120. Tension of the rods 150, 155 can be adjusted by replacing the shims 160, 165 with shims having thicker or thinner flanges 161, 166.

Once the tension of the rods 150, 155 is adjusted to the requirements of a user or a manufacturer, any remaining empty space within the support structure 100 is covered with a cover piece 170, which preferably is composed of a low density material such as plastic, composite, or aluminum alloy. The cover piece 170 preferably is permanently affixed to the body 20, but in alternative embodiments may be removable if the shims 160, 165 need to be adjusted or replaced. In an alternative embodiment, the empty space within the support structure 100 may be filled with a polymer, which may be injected into the support structure 100 to ensure that it is completely filled and that the shims 160, 165 are fixed in place.

In a third embodiment, shown in FIGS. 16-19, the golf club head has most of the same parts and features as the second embodiment, with the first ends 151, 156 of the rods 150, 155 fixed inside the first and second through-openings 140, 142 in the return section 32. Instead of a support structure 100 in the sole section 22, however, first and second unthreaded ports 180, 185 are disposed directly below each of the through-openings 140, 142, respectively. The ports 180, 185 each include support bosses 182, 187 and a ledge 183, 188. In this embodiment, the second end 152, 157 of each rod 150, 155 has a threaded counter-bore 154*a*, 159*a*. When the second end 152, 157 of each rod 150, 155 is disposed within its respective port 180, 185, a tuning screw 190, 195 is inserted into each counter-bore 154*a*, 159*a*. Each tuning screw 190, 195 has a head portion 191, 196 and a threaded extension portion 192, 197. When the tuning screw 190, 195 is tightened within the counter-bore 154*a*, 159*a*, the head portion 191, 196 abuts the ledge 183, 188 and the threaded extension portion 192, 197 pulls the rod 150, 155 toward the sole section 22, increasing its tension between the return section 32 and the sole section 22. Loosening the tuning screws 190, 195 reduces the tension of the rods 150, 155.

Figure 20:
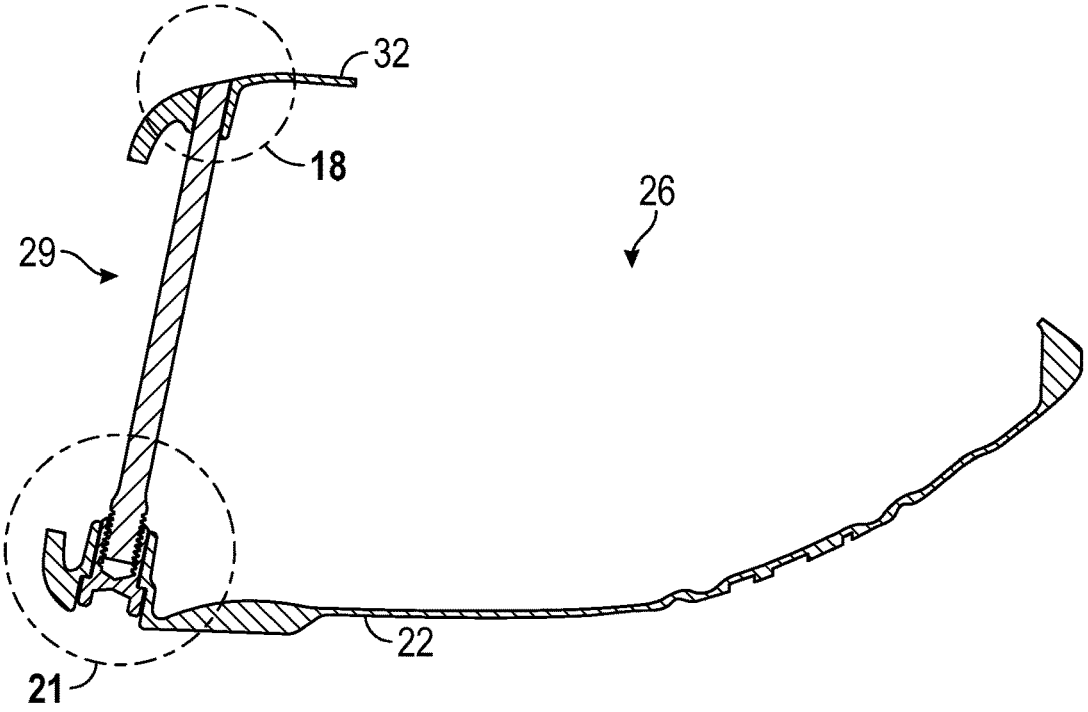
FIG. 20 is a cross-sectional view of a fourth embodiment of the golf club head of the present invention with its crown and face insert removed.
Figure 21:
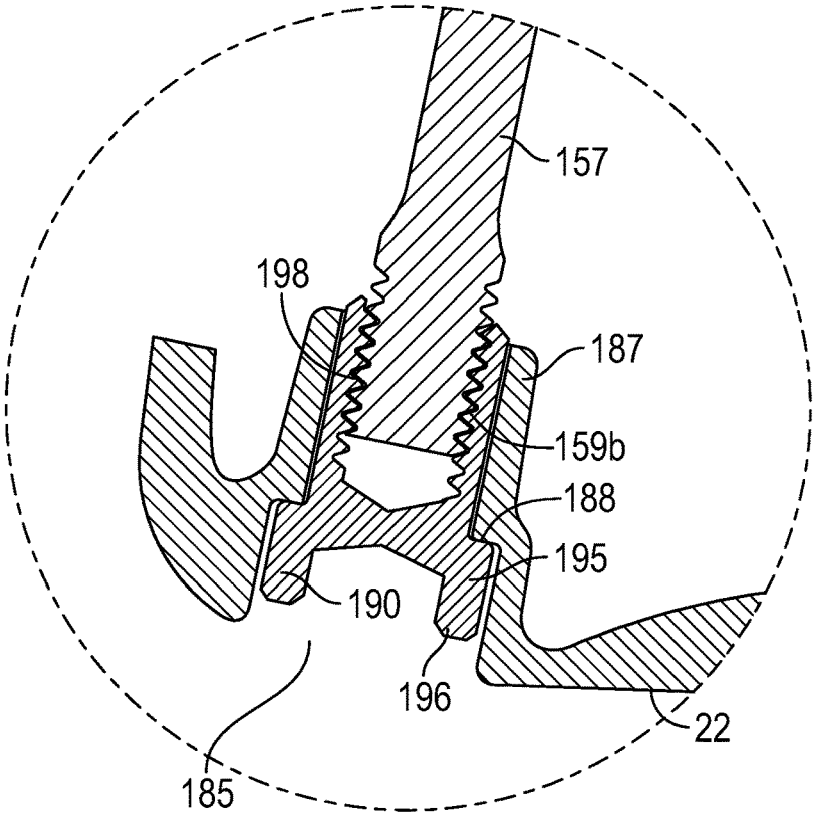
FIG. 21 is an enlarged view of the circled portion of the embodiment shown in FIG. 20.

In a fourth embodiment, shown in FIGS. 20-21, the golf club head 10 has all of the same characteristics as the third embodiment, except that second ends 152, 156 of the rods 150, 155 have external threads 154*b*, 159*b*, and the extension portions 192, 197 of the tuning screws 190, 195 have threaded counter-bores 193, 198 sized to receive the external threads 154*b*, 159*b* of the rods 150, 155. The second ends 152, 156 extend into the support bosses 182, 187 of the ports 180, 185, and the tuning screws 190, 195 are inserted into their respective ports 180, 185 so that the threaded counter-bores 193, 198 engage the external threads 154*b*, 159*b* of the rods 150, 155. Tightening the tuning screws 190, 195 within the ports causes the head portions 191, 196 to abut their respective ledges 183, 188 and pull the rods 150, 155 downward toward the sole section 22, thereby increasing tension of the rods 150, 155 between the return section 32 and the sole section 22. Loosening the tuning screws 190, 195 reduces the tension of the rods 150, 155.

Figure 22:
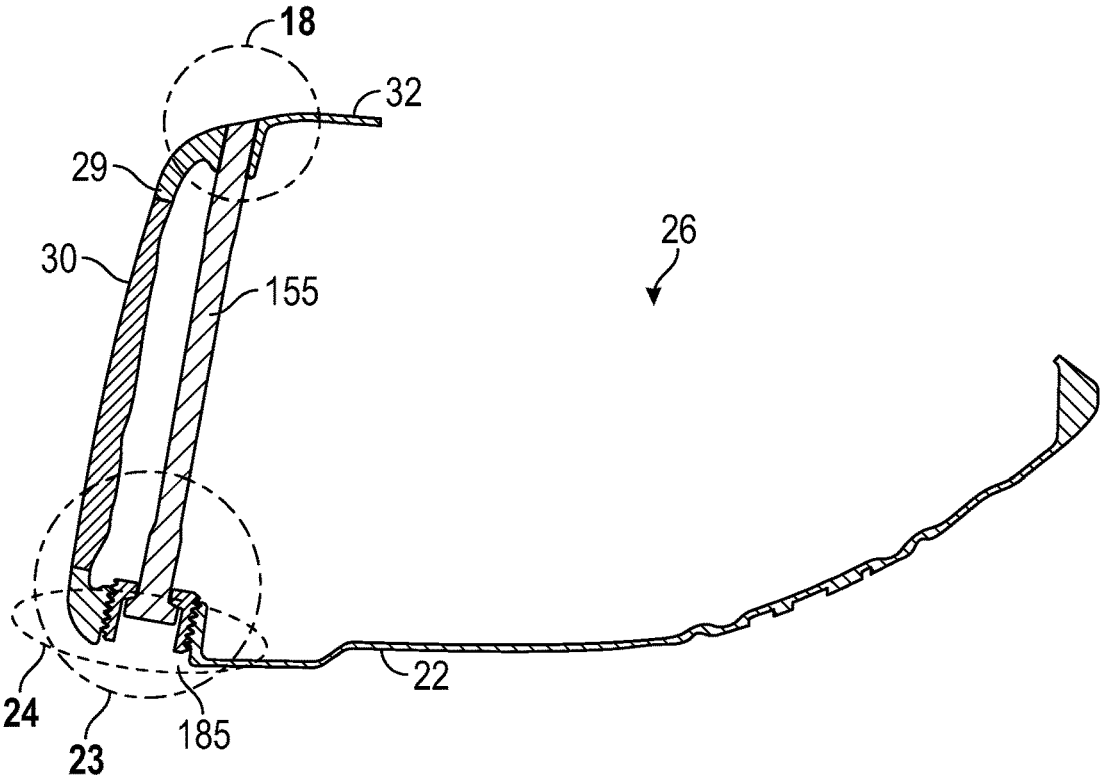
FIG. 22 is a cross-sectional view of a fifth embodiment of the golf club head of the present invention with its crown and face insert removed.
Figure 23:
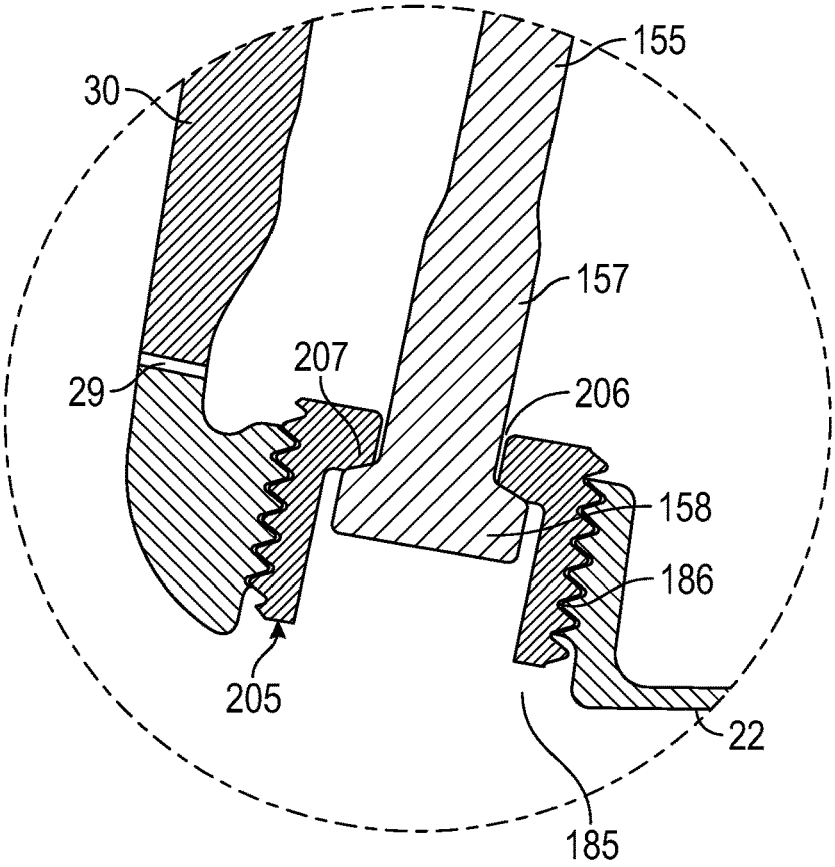
FIG. 23 is an enlarged view of the circled portion of the embodiment shown in FIG. 22.
Figure 24:
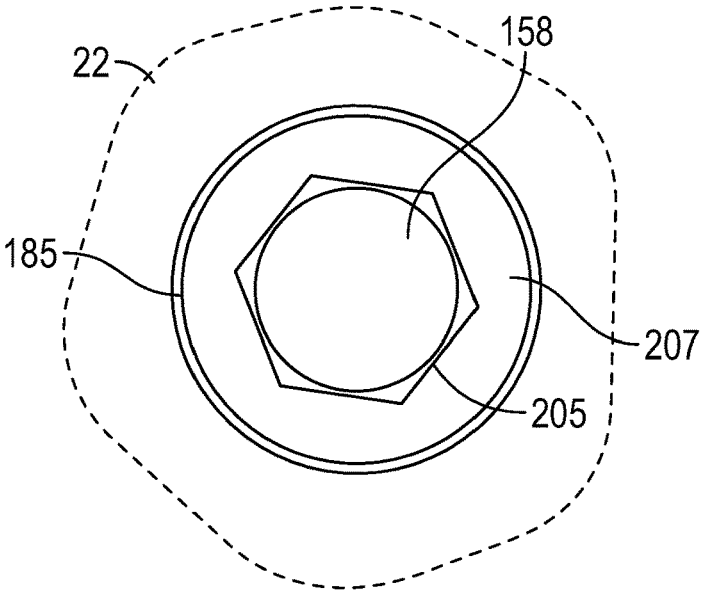
FIG. 24 is a sole plan view of the circled portion of the embodiment shown in FIG. 23.

In a fifth embodiment, shown in FIGS. 22-24, the rods 150, 155 have the features of the preferred embodiment, with plates 153, 158 at their second ends 152, 156. The ports 180, 185 have threaded through-bores 181, 186, and instead of tuning screws 190, 195, the embodiment makes use of collars 200, 205, each with a through-opening 201, 206 sized to receive the second ends of the rods 150, 155, a ledge 202, 207 against which the plates 153, 158, which cannot fit through the through-openings 201, 206, abut, and an externally threaded surface 203, 208 sized to engage the threads of the threaded through-bores 181, 186. In this embodiment, the first ends 151, 156 of the rods 150, 155 are threaded through the through-openings 201, 206 of the respective collars 200, 205 before being permanently affixed to the return section 32 within the through-openings 140, 142 there. The plates 153, 158 are each thereby retained within a collar space 204, 209 encircled by the externally threaded surfaces 203, 208 of the collars. The tension of the rods 150, 155 can be adjusted by engaging the externally threaded surfaces 203, 208 of the collars 200, 205 with the threads of the respective threaded through-bores 181, 186 in the ports 180, 185 and tightening or loosening the collars 200, 205 within the ports 180, 185 to achieve the desired tension.

For all of the embodiments disclosed herein, each stiffening member 50 or rod 150, 155 preferably is completely located within 1 inch, more preferably within 0.500 inch, and most preferably within approximately 0.433 inch of the interior surface 31 of the striking face section 30, measured along a vertical plane extending through the face center 34 perpendicular to the striking face section 30 and in a front-to-back direction. Locating the stiffening members 50 or rods 150, 155 within the region of the golf club head 10 defined above has the greatest stress-reducing effect on the golf club head 10, and particularly the striking face section 30.

The stiffening members 50 or rods 150, 155 of the present invention may be used as described herein in any type of golf club head with a hollow interior, including putters, irons, wedges, hybrids, fairway woods, and drivers. In any of the embodiments disclosed herein, when the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In fact, in the preferred embodiment, the golf club head 10 has a volume of approximately 450 cc to 460 cc. The volume of the golf club head 10 will also vary between fairway woods (preferably ranging from 3-woods to eleven woods) with smaller volumes than drivers. When designed as a driver, the golf club head 10 preferably has a mass of no more than 215 grams, and most preferably a mass of 180 to 215 grams; when designed as a fairway wood, the golf club head 10 preferably has a mass of 135 grams to 200 grams, and preferably from 140 grams to 165 grams. The mass of the body 20, and thus the overall discretionary mass of the golf club head 10, can be adjusted by creating a cutout 21 in the sole section 22 and filling it with an insert 90 composed of a lightweight material such as carbon composite, plastic, or a low density metal alloy. Similarly, the crown insert 42 can be formed of a carbon composite material to free up additional discretionary mass.

The golf club head 10 preferably has a characteristic time (CT) of the striking face section 30 close to, but not exceeding, the 257 microsecond ("μS") limit set by the USGA, and the striking face section 30 preferably has a varying thickness such as that described in U.S. Pat. No. 7,448,960, for a Golf Club Head With Variable Face Thickness, which pertinent parts are hereby incorporated by reference. Other alternative embodiments of the thickness of the striking face section 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which are hereby incorporated by reference. Alternatively, the striking face section 30 has a uniform thickness.

The materials used to make the various parts of the inventive golf club head 10 may vary, but in the preferred embodiment, each part of the stiffening members 50 or rods 150, 155 preferably is composed of a solid, lightweight, strong metal material such as titanium alloy or steel. In an alternative embodiment, one or more of the parts of the stiffening members 50 or rods 150, 155 can be composed of a lightweight metal or a composite material. The body 20 is preferably cast from molten metal in a method such as the lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body 20 using centrifugal casting, casting the body 20 using levitation casting, and like manufacturing methods.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

The invention claimed is:

1. A golf club head comprising:

a body comprising a striking face section having a face interior surface, an upper perimeter and a lower perimeter, a crown return section extending rearward from the upper perimeter of the striking face section, a sole section extending rearward from the lower perimeter of the striking face section, a hollow interior, and a support structure extending into the hollow interior from the sole section;

a first rod comprising a first upper end, a first midpoint, a first lower end, and a first plate affixed to the first lower end; and a first shim comprising a first body and a first flange, wherein the support structure comprises a first pocket with a first floor and a first through-hole extending through the first floor in communication with the hollow interior, wherein the first upper end of the first rod is permanently affixed to the crown return section, wherein the first midpoint of the first rod is suspended within the hollow interior, wherein the first lower end of the first rod extends through the first through-hole so that the first plate is disposed outside of the hollow interior and is received within the first pocket, wherein the first shim is disposed within the first pocket so that the first flange extends between the first plate and the first floor, wherein each of the first rod and the support structure is located entirely within one inch of the interior surface of the striking face section, and wherein no portion of the first rod and support structure makes contact with the striking face section.

2. The golf club head of claim 1, wherein the first flange moves the first plate away from the sole section and increases tension of the first rod.

3. The golf club head of claim 1, wherein the first body of the first shim is sized to fit within and fill the first pocket.

4. The golf club head of claim 1, further comprising a second rod having a second upper end, a second midpoint, a second lower end, and a second plate, wherein the support structure comprises a second pocket with a second floor and a second through-hole extending through the second floor and in communication with the hollow interior, wherein the second upper end of the second rod is permanently affixed to the crown return section, wherein the second midpoint of the second rod is suspended within the hollow interior, and wherein the second lower end of the second rod extends through the second through-hole so that the second plate is disposed outside of the hollow interior and is received within the second pocket.

5. The golf club head of claim 4, wherein each of the first rod and the second rod has a variable diameter.

6. The golf club head of claim 4, wherein the support structure comprises a divider wall that separates the first pocket from the second pocket.

7. The golf club head of claim 1, further comprising a cover piece, wherein the cover piece is affixed to the body to cover the first pocket of the support structure.

8. The golf club head of claim 7, wherein the body is composed of a first material having a first density, wherein the cover piece is composed of a second material having a second density, and wherein the second density is less than the first density.

* * * * *